US006010257A

United States Patent [19]

Petteruti et al.

[11] Patent Number: 6,010,257

[45] Date of Patent: Jan. 4, 2000

[54] MINIATURE PORTABLE INTERACTIVE PRINTER

[75] Inventors: Steven F. Petteruti, East Greenwich; Majid Amani, Coventry, both of R.I.; William F. Genett, Marblehead, Mass.; Richard A. Perry, Charlotte, N.C.

[73] Assignee: Comtec Information Systems Inc., Warwick, R.I.

[21] Appl. No.: 09/187,713

[22] Filed: Nov. 6, 1998

Related U.S. Application Data

[63] Continuation-in-part of application No. 09/095,302, Jun. 10, 1998, which is a continuation of application No. 08/819,746, Mar. 18, 1997, Pat. No. 5,806,993.

[51] Int. Cl.[7] ..... B41J 3/36

[52] U.S. Cl. ..... 400/88

[58] Field of Search ..... 400/88; 340/825.69; 395/114

[56] References Cited

U.S. PATENT DOCUMENTS

| | | | |
|---|---|---|---|
| 4,108,706 | 8/1978 | Brands et al. . | |
| 4,468,274 | 8/1984 | Adachi . | |
| 4,497,682 | 2/1985 | Hamisch, Jr. . | |
| 4,614,949 | 9/1986 | Hakkaku et al. . | |
| 4,707,221 | 11/1987 | Shibata . | |
| 4,784,714 | 11/1988 | Shibata . | |
| 4,896,166 | 1/1990 | Barker et al. . | |
| 4,910,602 | 3/1990 | Sakurag . | |
| 4,938,616 | 7/1990 | Shiozaki et al. . | |
| 4,947,185 | 8/1990 | Mitsushima et al. . | |
| 5,036,338 | 7/1991 | Imai . | |
| 5,265,966 | 11/1993 | Schmidt . | |
| 5,267,800 | 12/1993 | Petteruti et al. . | |
| 5,366,302 | 11/1994 | Masumura et al. . | |
| 5,487,337 | 1/1996 | Uland . | |
| 5,497,701 | 3/1996 | Uland . | |
| 5,503,483 | 4/1996 | Petteruti et al. | 400/88 |
| 5,524,185 | 6/1996 | Na | 395/114 |
| 5,524,993 | 6/1996 | Durst . | |
| 5,560,293 | 10/1996 | Boreali et al. . | |
| 5,606,314 | 2/1997 | Mitsuhashi et al. | 340/825.69 |
| 5,696,499 | 12/1997 | Mitsuhashi et al. | 340/825.69 |
| 5,727,135 | 3/1998 | Webb et al. | 395/113 |

*Primary Examiner*—Edgar Burr
*Assistant Examiner*—Charles H. Nolan, Jr.
*Attorney, Agent, or Firm*—M. Lukacher; Kenneth J. Lukacher

[57] ABSTRACT

An intelligent, portable printer is provided having a controller and a printing mechanism. The controller includes a microprocessor which communicates with a terminal, which may be remote from the printer and may include or be a host computer, via cable, radio, or optical interfaces. The terminal supplies application programs and data representing commands and information to be printed. In one embodiment, the controller of the printer can operate the printer mechanism in accordance with received data when the data is preceded by a command addressing the product-type predefined for the printer. In another embodiment, the controller operates responsive to a wake-up signal from the terminal for automatically turning on the printer from a low powered state. In a further embodiment, an antenna in the printer receives RF signals from the terminal and circuitry is provided for enabling power to the controller from the printer's power source when the RF signals received represent a wake-up signal or code, thereby turning on the printer.

22 Claims, 11 Drawing Sheets

MINIATURE PORTABLE INTERACTIVE PRINTER

This is a continuation-in-part application of U.S. application Ser. No. 09/095,302, filed Jun. 10, 1998, which is a continuation of U.S. application Ser. No. 08/819,746, filed Mar. 18, 1997, and now U.S. Pat. No. 5,806,993.

DESCRIPTION

The present invention relates to printers which are operated by digital data, and particularly to a miniature, portable, intelligent printer which is interactive with a terminal which supplies applications programs and data representing commands and information to be printed to the printer.

A printer provided by the invention is especially suitable for use in portable printing to print labels (by which is meant shelf labels, tickets, stickers, and other patches) which may be adhesively, releasable attached to a web carrier (so-called "label-stock") or which may comprise a strip of continuous label material wound in roll form without a web carrier (so-called "linerless stock"). Such printing can be performed on site (in the warehouse, retail store, or factory where labels are required) because the printer is portable and miniature in size, and because the printer can communicate with a host terminal via radio or optical interface and therefore does not require a cable connection. A printer provided by the invention may occupy a volume of about 60 cubic inches or less, may weigh about 1.5 pounds or less, and may be operated in a network of such portable printers and terminals.

Label printers have been used on factory floors, in warehouses, and in retail establishments for ticket printing and inventory control. Since the printers are portable and may be carried on the person of the user, it is desirable that the size and weight thereof be minimized.

More recently, smaller printers have been proposed, especially for use with linerless label stock. However, such printers may not be easily portable.

In one type of linerless stock, the adhesive side of the strip is releasable from the face side of the next convolution of the roll, similar to a roll of adhesive tape. When unwound, such stock can be difficult to convey through a printer and can foul the apparatus during use through build-up of transferred adhesive.

U.S. Pat. Nos. 4,707,211 issued Nov. 17, 1987 to Shibata and 4,784,714 issued Nov. 15, 1988 to Shibata disclose a desk-top printer for printing linerless label stock. The device avoids the problems inherent in conveying tacky stock by using a special label stock having a thermally-activatable adhesive, requiring a special heating section in the printer. This can add to the cost, complexity, size, and weight of the printer.

U.S. Pat. No. 4,468,274 issued Aug. 28, 1984 to Adachi discloses use of a thermally-activatable adhesive and proposes a heat-transferable conveyor for conveying the tacky stock through the printer.

U.S. Pat. No. 5,560,293 issued Oct. 1, 1996 to Boreali et al. discloses a linerless label printer and transport system wherein tacky web may be conveyed. All the substantially stationary printer components which may come into contact with the tacky surface, such as a label guide, transport plate, front panel, and stripper blade, have the adhesive-facing surfaces plasma coated. Plasma coating of parts can add significantly to the manufacturing cost of the printer.

U.S. Pat. No. 4,108,706 issued Aug. 22, 1978 to Brands et al. teaches to use vacuum to hold and advance tacky labels through a label printer. Vacuum conveyance can add complexity, size, weight, and cost to such a printer.

U.S. Pat. No. 5,267,800 issued Dec. 7, 1993 to Petteruti et al. and U.S. Pat. No. 5,524,993 issued Jun. 11, 1996 to Durst discloses an automatic print speed control for a barcode printer including a printhead to which power is applied during a strobe time to cause the printhead to print. The printer also includes a stepper drive motor that is responsive to a drive signal derived from a number of measured operating variables of the printer to adjust automatically the printhead strobe time. The printer lacks the ability, however, for a user to input settings in real time for additional subjective variables such as contrast and tone, or to override the measured operating values, which can be a serious shortcoming when a user desires some printing effect other than that which the control system automatically provides. In addition, the sensor lens of a paper-presence detector in U.S. Pat. No. 5,524,993 is contacted by the label stock passing through the printer and can be fouled and rendered inoperative by build-up of material transferred from the stock.

U.S. Pat. No. 5,267,800, ('800) which is herein incorporated by reference, discloses an intelligent, interactive, portable printer having a microprocessor controller, a printing mechanism, and a web feed mechanism integrated into an assembly which together with a battery pack, may weigh about 2 pounds and be about 80 cubic inches in volume. The microprocessor communicates interactively with a terminal, which may contain a host computer and which supplies programs and data representing the information to be printed. The controller in the printer converts such data into bar codes, graphics, text, or lines for operating the printer mechanism. The state of the printer is communicated to the terminal and both operate interactively to produce labels. The terminal may be, for example, a cash register with its associated input device such as an optical character recognition device, bar code scanner, or magnetic stripe reader. The terminal may be connected to the printer via a hard wire, radio (RF), or optical link. The printer disclosed in '800 is intended expressly for use with label stock having a liner and is not suited for use with either tacky or heat-activated linerless label stock.

It is often desirable to interface multiple label printers to a single host computer or terminal to provide the flexibility of printing from one or more printers. For example, a user may have a terminal and carry several different types of portable printers which can each operate responsive to data from the terminal, such that different types of labels may be printed. However, this is problematic because all of the printers will print responsive to the data simultaneously received from the terminal due to the terminal's inability to distinguish data designated for one printer product or model type from data designated to printers of other product or model types. If the user wishes to switch from one type of printer to another, the user must turn off or disable all other printers, such that only one printer can communicate with the terminal, which is both time consuming and can lead to loss of information in the printers turned off.

Another desirable feature for a label printer is the capability of turning on, or waking up, the printer automatically from a terminal by applying a wake-up signal to the printer, such that the printer can either be off, or in a very low power mode, until operation of the printer is actually needed. This can increase the life of the battery of the typical printer, or reduce the time needed for the next recharge, if the battery is of a rechargeable type. It also permits the user to only be required to turn on one device, the terminal, which in turn can enable power within the printer. This is particularly useful when communicating between the terminal and the printer.

It is one object of the present invention to provide an improved portable printer which can operate in accordance with received data when addressed to the product-type predefined for that printer, and not operate when printers of other product-types are addressed.

It is another object of the present invention to provide an improved portable printer which automatically turns on responsive to a wake-up signal or code from a host computer or terminal.

Briefly described, a printer embodying the present invention is responsive to data representing commands and information to be printed. The printer has a printing mechanism including printing elements. The controller includes a microprocessor for receiving data from a terminal via cable, radio, or optical interfaces. The terminal may be remote from the printer, and may include or be a host computer. The controller operates the printer mechanism in accordance with received data from the terminal when the data has a product-type (PTYPE) command addressing one of the product-types predefined for the printer, and does not operate the printer mechanism when printers of other product-types are so addressed. Thus, when the printer represents one of multiple printers which can receive data simultaneously from a terminal, only those printers having at least one of the predefined product-types will operate responsive to the data.

In another embodiment, the printer embodying the present invention has a controller and a power source for supplying power to the printer. The printer includes an antenna for receiving RF signals from a terminal, and circuitry connected to the antenna for enabling power to be supplied from the power source to the controller when the RF signals represent a wake-up signal from the computer terminal, thereby automatically turning on the printer. The wake-up signal may represent RF signals having an amplitude above a threshold level corresponding to a bit pattern of at least one predefined wake-up code.

In a further embodiment, the printer embodying the present invention operates responsive to a wake-up signal from a terminal for turning on the printer from a low powered state. In a low powered state, at a minimum, only the communication interfaces of the printer are powered for receiving the wake-up signal from the terminal, and the controller of the printer operates at a reduced clock rate. The controller turns on the printer from its low powered state responsive to a received wake-up signal, which may represent data of one or more characters.

The foregoing and other objects, features, and advantages of the invention, as well as a presently preferred embodiment thereof, will become more apparent from a reading of the following description in connection with the accompanying drawings in which.

Figure 1:
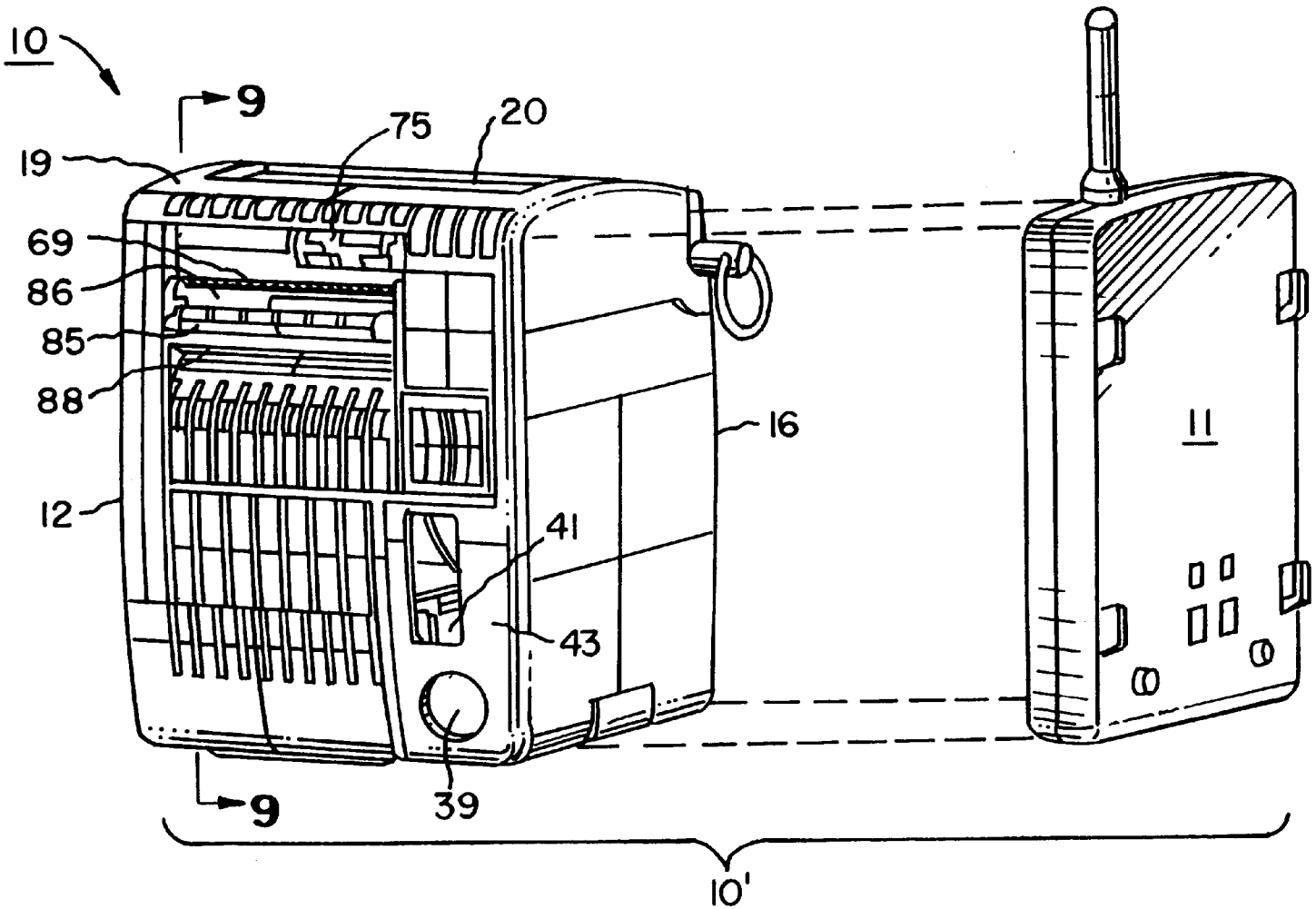
FIG. 1 is a perspective view showing the front, top, and one side of a printer in accordance with the invention, with an associated wireless (RF) control pack.

Referring to FIGS. 1 through 4, there is shown a miniature printer 10 having a housing 12 which is generally rectangular in shape. The housing is made of left and right case shells 14 and 16, respectively, molded of plastic material, preferably polycarbonate. A gasket plate 15 is disposed between shells 14 and 16. The housing includes a top cover assembly 18 which includes a top cover shell 19 on which is disposed a key pad 20. A controller assembly 22 is disposed within right shell 16 and is connected to key pad 20 via a multi-channel ribbon cable 17. Preferably, cover 18 is openably connected to shells 14 and 16 by a hinge 24 which includes a hinge pin 26 received by a guides 28 in the case and bushings 30 in the cover, being secured by split rings 32 through the bushings. These rings may be connected to a strap or chain (not shown) which may be used to connect the printer to the belt of the operator or may be extended to carry the printer on the operator's shoulder.

Also shown in FIG. 1 is an RF control pack 11 for use with printer 10, as discussed hereinbelow, to form an integrated radio-interfaced printer unit 10'. The interface elements in such a control device are well known and need not be further discussed.

The key pad 20 has a key 21 for turning the printer on, a key 23 for turning the printer off, and a key 25 for energizing a drive motor 27 for advancing the label stock. These keys may be push buttons. The drive motor 27 is a stepper motor.

Figure 5:
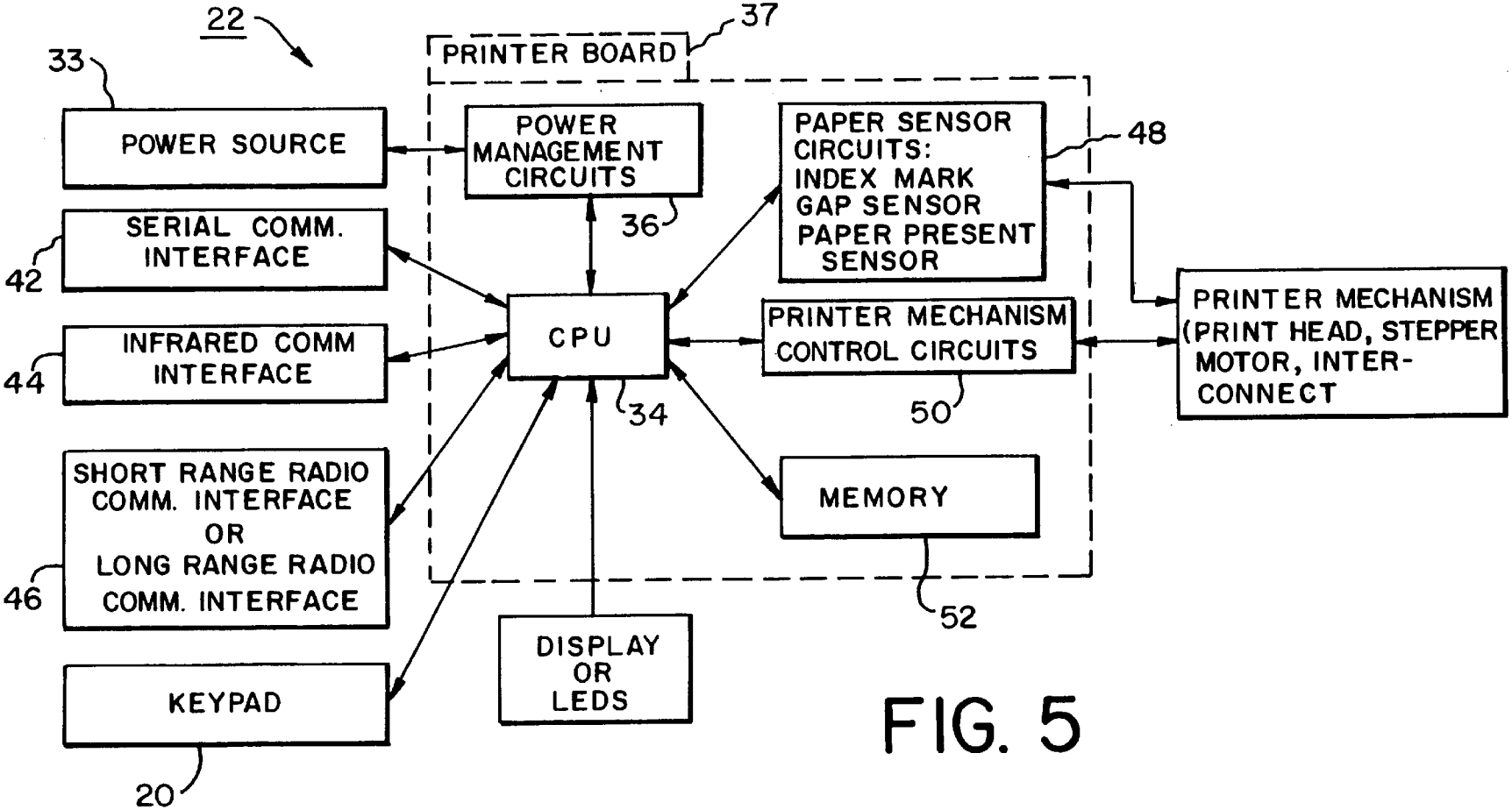
FIG. 5 is a schematic control diagram of a printer in accordance with the invention.
Figure 7:
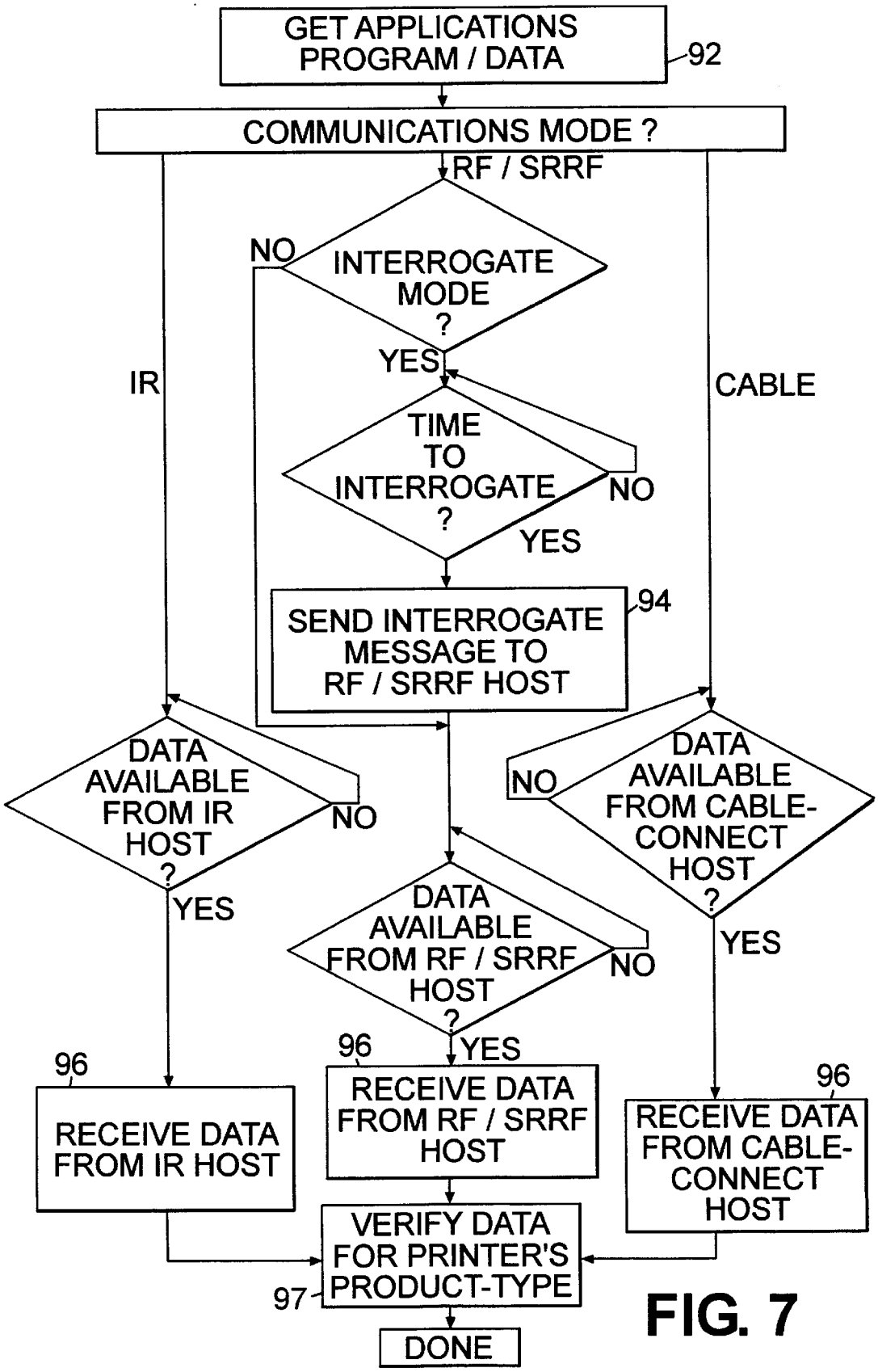
FIG. 7 is a flow chart of the "Get Commands/Data" subroutine for checking the printer status and preparing the printer to print in the program shown in FIG. 6.

The controller assembly 22 includes the computer and input and output circuits therefrom which are illustrated in FIG. 5 and which correspond in detail with the control circuits shown in FIG. 7 in the incorporated '800 reference. The central processing unit (CPU) 34 is a microprocessor having various inputs and outputs. Power management circuits 36 control the voltage and amperage supplied to the CPU from power source 38, preferably a rechargeable battery pack 40, which is received in battery well 45 in housing 12 and retained by button 47 and latch 49. Communications interfacing with the CPU may be through a serial (cable-connect) 42, infrared (IR) 44, or radio frequency (RF) 46, either Short Range or Long Range. Key pad 20 provides commands to the CPU. The paper sensor circuits 48 control the paper-related functions: the sensing of index marks on the paper, the sensing of gaps between labels adhered to the liner, and the presence of paper in the print head. (The stock is preferably white and reflective and may have printed thereon indicia, for example, black lines between the labels, which demarcate the location of the labels. The stock also may have gaps between the labels, such gaps also constituting location indicia.) The printer mechanism control circuits 50 control the mechanical and electrical components, described hereinbelow, which advance and print the label stock. The memory 52 includes a random access memory (RAM) and a read-only memory in the form of an erasable, programmable read-only memory (EPROM).

The controller is mounted on a printed circuit board 37. The board 37 is connected to an input/output connector 39 and to an infrared sensor (not shown) behind a window 41, both of which are mounted in the front wall 43 of the housing 12. The connector and sensor also have inputs from the power management circuits 36. It may be desirable to wrap the controller board and the components mounted thereon in an electromagnetic interference (EMI) shield provided by electromagnetic field shielding material, for example, fabric covered by conductive material which is connected to ground.

The left shell 14 is molded to permit mounting of various printer components into a left-case assembly 13, and has a well 54 open at the top and left side wall 55 to receive a roll of label stock (not shown). The well 54 may include an axial mandrel 56 cantilevered on a bushing 58 from right side wall 60 to support a spooled roll of label stock. A roll is captured on the mandrel by a stock retainer collar 62 having flexible fingers 64 in a circular array. These fingers extend inwardly from a flange 66 and enter between the peripheral surface of mandrel 56 and the interior peripheral surface of the roll of stock material. The flange 66 is located laterally on the collar depending upon the width of the roll of stock material.

Figure 2:
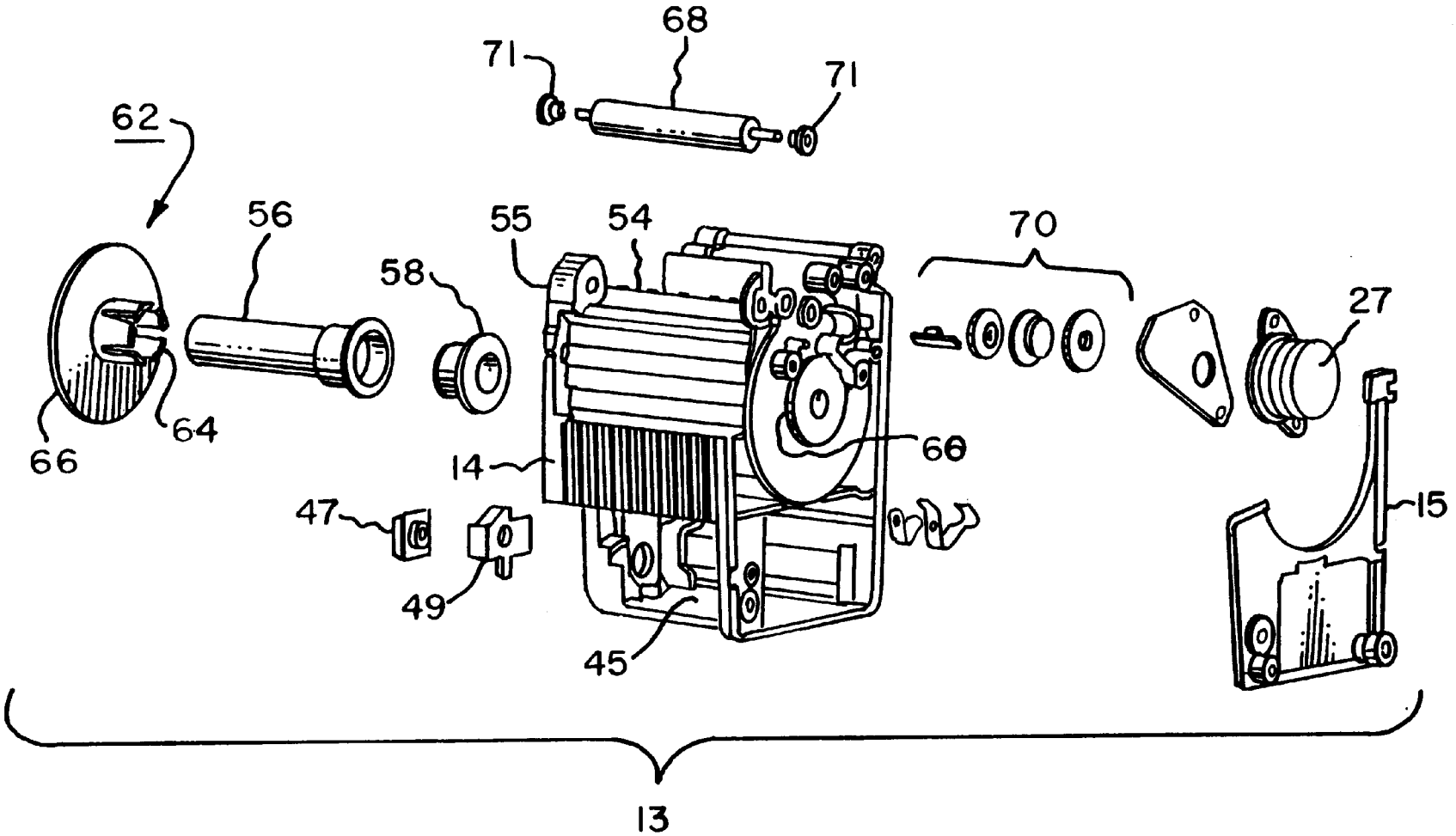
FIG. 2 is a perspective, exploded view of the printer case assembly shown in FIG. 1.
Figure 3:
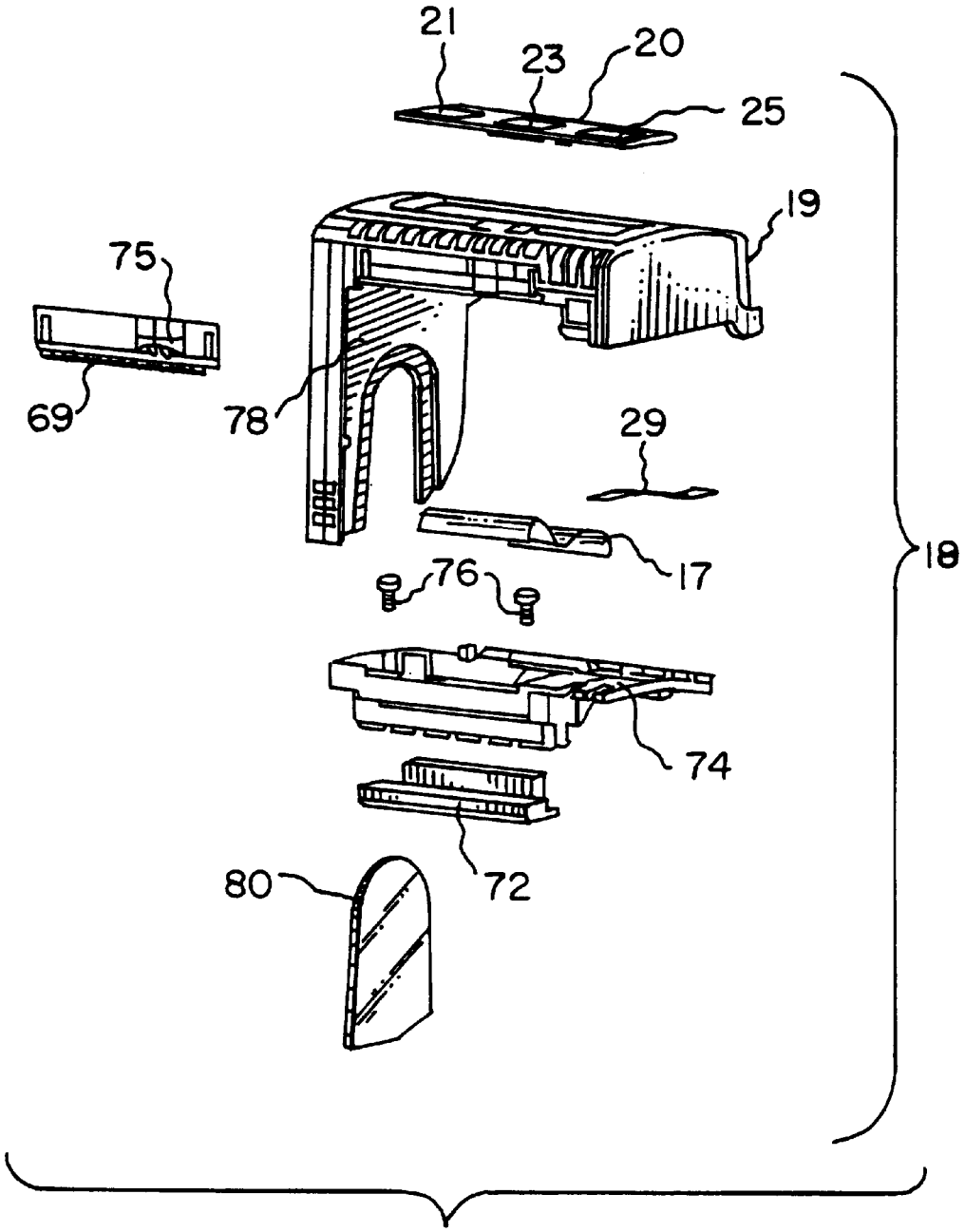
FIG. 3 is a perspective, exploded view of the top cover assembly shown in FIG. 1.

The assembly constituting the printer mechanism is shown in FIGS. 2 and 3. Stepper drive motor 27 is connected to a platen drive roller 68 by a gear train 70, which roller is journalled in bushings 71 in housing 12. The thermal printer mechanisms's thermal head array of printing elements 72 is disposed, in print position, adjacent to the roller 68 and acts as a pressure pad to hold the stock against the roller so that the stock may be driven by the roller. The stock is driven solely by the platen roller. Preferably, the platen roller 68 is formed from a resilient polymeric material having release properties toward adhesives commonly in use on linerless label stock, for example, a silicone polymer, which permits the conveying of adhesive-backed labels by the platen roller without fouling of the roller surface.

The thermal printer array 72 (consisting of a metal heat sink bar and an insulating bar in which a row of 384 elements is contained) is mounted in a flexural assembly within the top cover shell 19. The assembly is made of a flexural plate 74 which is thin, flexible, and arcuately curved. Plate 74 provides a biased spring on the underside of top cover shell 19, the bias of which may be set by adjustment of calibration screws 76. The thermal printing array 72 can be easily replaced by removing the calibration screws 76. This flexural mounting of the print head 72 allows the print head to float, which permits printing on different stocks having different thicknesses without adjustment of the spacing between the print head and the platen roller. The floating head configuration also prevents the printer mechanism from being affected by external pressure on cover 18, and uses leaf switch 29 to sense loss of pressure at the printing surface, which switch is coupled to CPU 34.

A serrated tear bar 69 is provided in top cover 18 for separating non-perforated or die-cut labels after printing. The top cover assembly 18 also has a side wall 78 and window 80 for covering the outer end of stock well 54 and permitting visual monitoring of the amount of label stock remaining in the well.

The presence of paper in the printer is sensed by an optical sensor 75 which does not require contact with the paper and therefore cannot be fouled by build-up of adhesive during printing. The sensor 75 is disposed preferably in top cover assembly 19, or alternatively in the printer case below the web path and just ahead of the platen roller. The sensor detects web by projecting an optical beam against the web and sensing a reflection therefrom. There is also a temperature sensor (not shown) in the print head 72 (a thermistor) which detects the temperature of the thermal head array and provides an output to the CPU 34.

Figure 4:
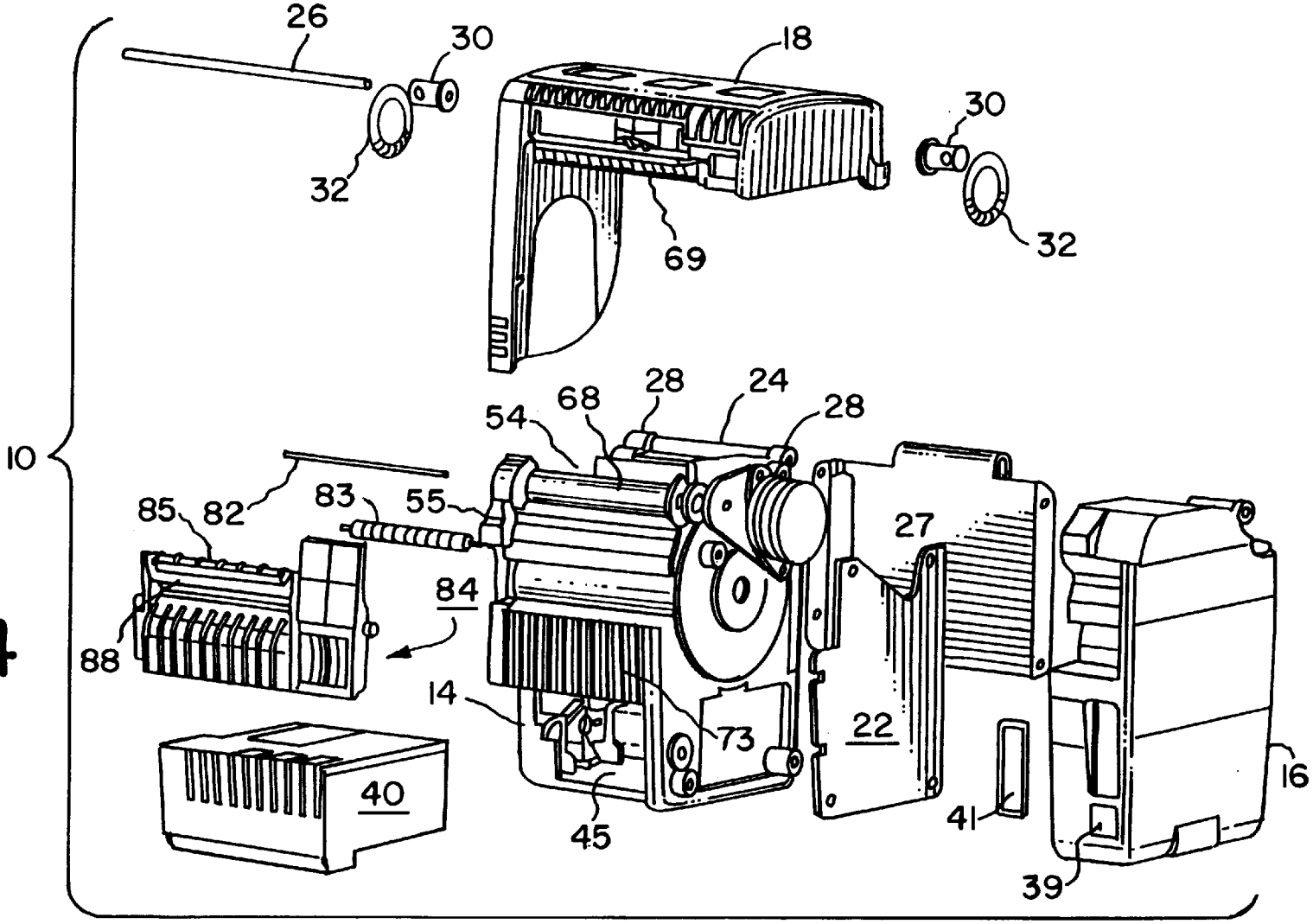
FIG. 4 is a perspective, exploded view of the entire printer assembly shown in FIG. 1 with an optional integrated RF interface.

As shown in FIGS. 1, 2, and 4, the printer is equipped with an automatic label peeler mechanism having a peeler bar 82. This bar is integral with a toggle latch assembly 84 tiltably mounted as a portion of the front wall 73 of left shell 14 for securing the top cover assembly 18 in closed, operating position. The configuration and function of the peeler bar is substantially as described in the incorporated '800 reference. Peeler bar 82 also cooperates with top cover 18 to form a first opening 86 in housing 12 when the top is closed, through which opening printed web or labels can exit the printer. A second opening 88 between peeler bar 82 and a lower portion of latch assembly 84 provides an exit from the printer for label liner which has been separated from the label by the peeler bar after printing of the label, as described in the incorporated '800 reference. Label stock may be threaded into the printer mechanism simply by opening the cover, leading the stock over the platen roller and the peeler bar, and closing the cover.

The printer 10 constitutes an integrated assembly of all the components discussed above, the principal ones of which are the electronic controller assembly, the printer mechanism including the platen roller having a releasing surface and the print head mounted in a hinged cover, and a non-contact paper-presence sensor. This integrated assembly is light in weight and may be of a weight not exceeding 1.5 pounds. The dimensions of the assembly including the battery pack may be 5.0 inches high, 3.0 inches deep, and 4.0 inches wide, the volume occupied being about 60 cubic inches (75 cubic inches with radio control pack 11.) Optionally, RF interface 46 may be provided as an integrated board in the printer without RF control pack 11, as shown in FIG. 4.

The printer 10 is adapted for control and to receive data representing the information to be printed from a terminal, which may contain or may be a host computer, which may be connected to the printer by way of the I/O connector 39 or the radio or IR link. The protocol for transferring digital data may be as described in the '800 patent.

The printer in accordance with the invention may be employed as one of a network of printers, all in communication with a central computer terminal or a plurality of terminals. Communications means (type of interface: RF, IR, or cable) is preferably the same for all printers. The printers in the network may be addressed individually or collectively by the terminal to print different or identical labels. Each printer is able to distinguish data provided to it by the terminal from data being provided to other printers, is able to print that associated data, and is able to acknowledge to the terminal that the data were successfully printed.

Figure 6:
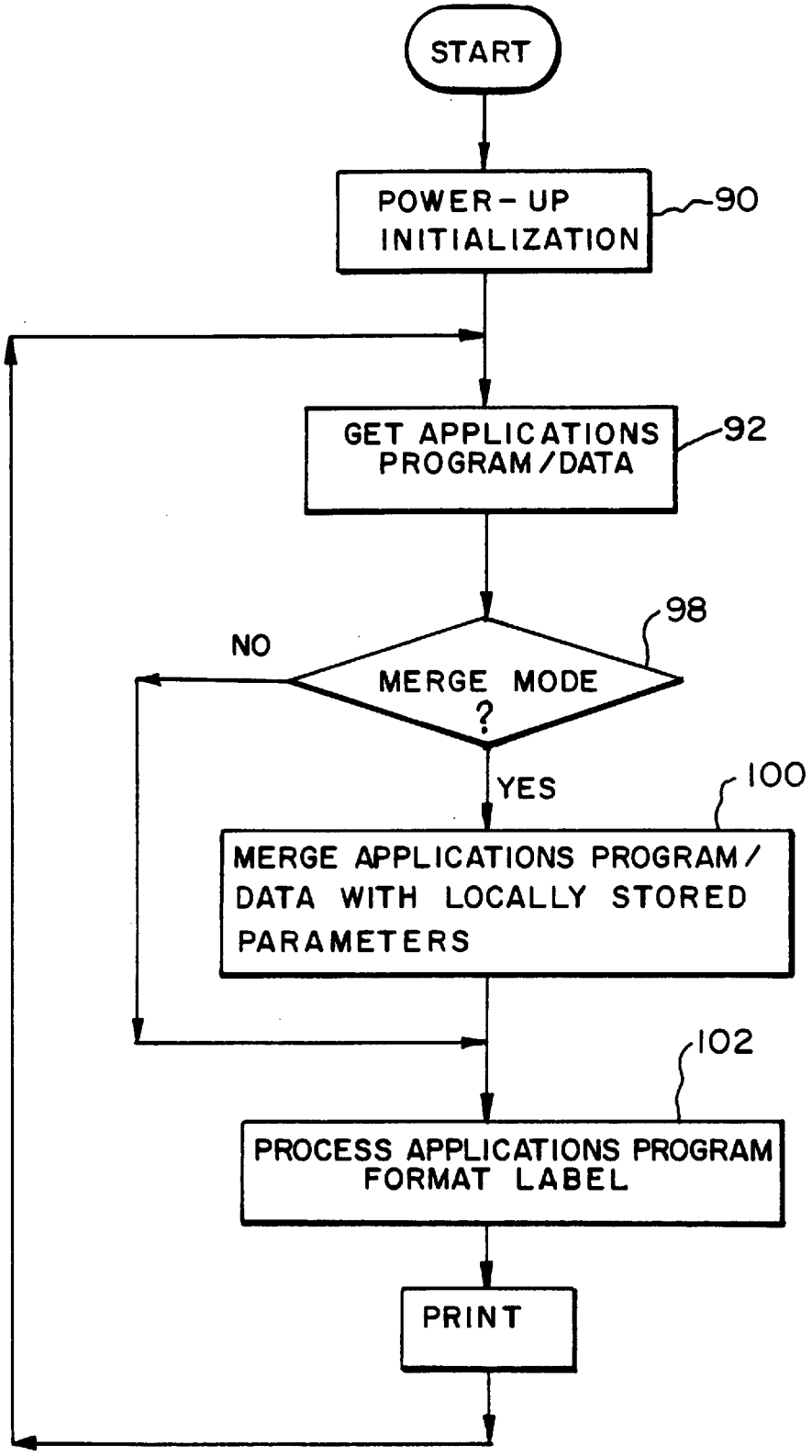
FIG. 6 is a flow chart illustrating the computer system operation (the program) for printing labels which is carried out in the computer system of a printer in accordance with the invention.

FIG. 6 shows the sequence of events after start-up necessary to prepare the printer to print. After a series of self-test parity checks and initialization 90, the controller executes the subroutine "Get Application Program/Data" 92 shown in detail in FIG. 7. After determining that the controller is ready to communicate via one of the three interface pathways (optical/infrared, cable connect, or radio), that it is in interrogate mode and that it is time to interrogate, the controller sends a request for data 94 from the terminal host, and the host replies by sending the data 96 when available.

When printer 10 is first powered, it is in a default state, whereby it responds to any data sent from the computer terminal. However, when the printer is one of multiple printers which can communicate with the computer terminal, the terminal can designate one or more of the printers by their product-type in the data sent to all the printers by using a product-type addressing (PTYPE) command. The PTYPE command is followed by a list of one or more printer product-types and then by the data containing the information to be printed or other commands for the printers of the product-types on the list. The printers having product-types following the PTYPE command operate responsive to such data or other commands from the terminal until the next PTYPE command is received. All other printers not having product-types following the PTYPE command ignore all data from the terminal, until the next PTYPE command is received which addresses their product-type. The terminal can reset all printers to their default state by placing after a PTYPE command a universal product-type identifier, such as ALL. Memory 52 (FIG. 5) stores one or more predefined product-types for the printer, including the universal product-type identifier. If a PTYPE command is detected by the printer in the received data at 96, the printer performs the sequence of events for subroutine "Verify Data For Printer's Product-type" 97 shown in FIG. 7A to determine whether the printer 10 should operate in accordance with the received data, otherwise, the printer remains in its default state of responding to any data received and the subroutine "Get Application Program/Data" 92 is done.

Figure 7A:
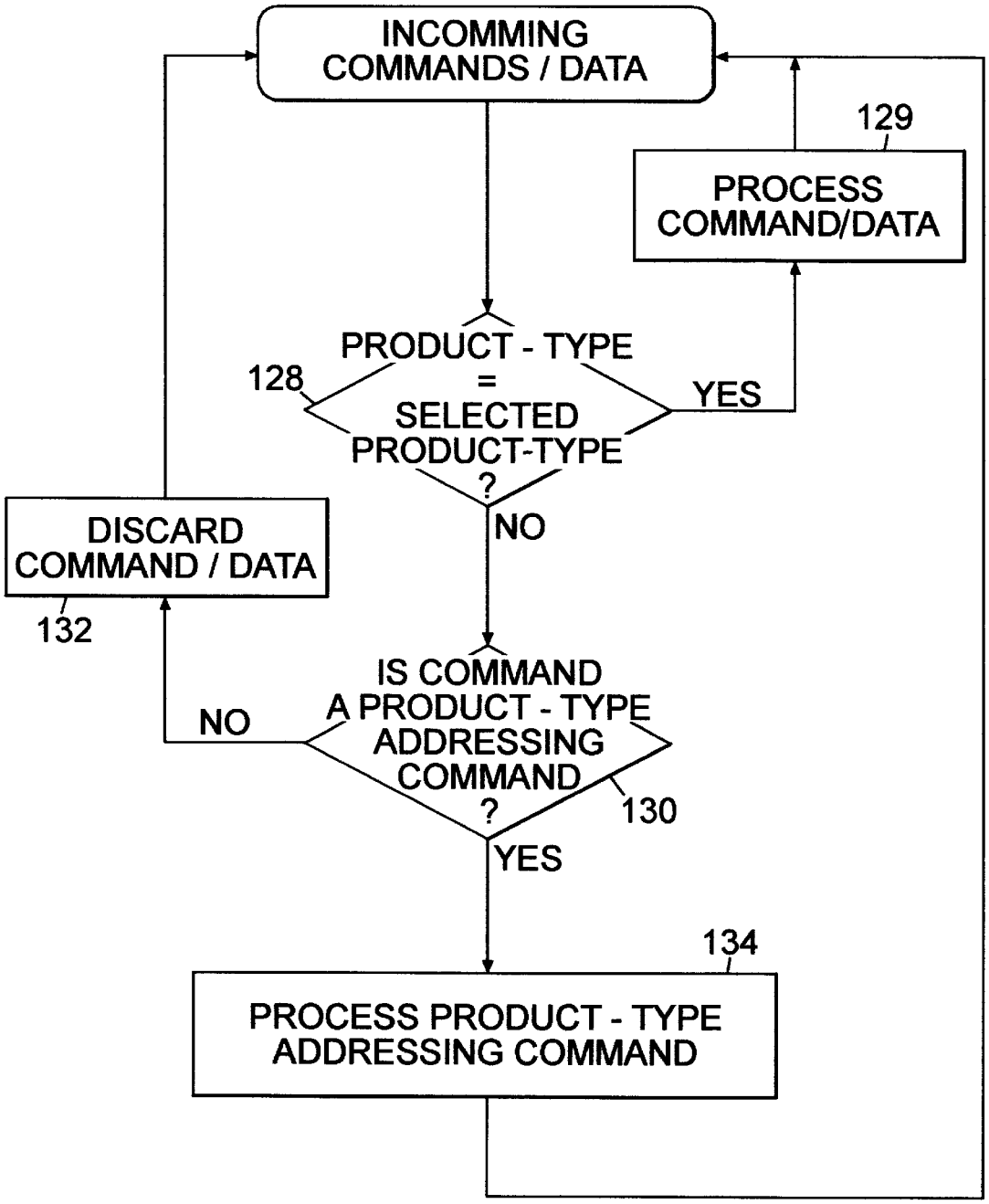
FIG. 7A is a flow chart of the "Verify Data For Printer's Product-type" subroutine shown in FIG. 7.

Referring to FIG. 7A, data received from the terminal is indicated as "command/data" since data may include commands, data to be printed, or an application program. When only one printer of the multiple printers is addressed, the input data received by the controller may be, for example, PTYPE PRINTER1 <Data to be Printed, or other commands>, where PRINTER1 represents the product or model type of a printer. In parsing through the input data, the controller first evaluates PTYPE. The controller checks at 128 if this is a product-type matching one of the product-types predefined for the printer. Since PTYPE does not represent a product-type, the controller then checks at 130 if it is a PTYPE command. Since this is the case, the controller at 134 processes the command as a PTYPE command, and the controller will now ignore all data from the terminal until a product-type matching one or the product-types for the printer is found in the input data from the terminal. The controller then branches back to 128 and evaluates the next part of the input data, by checking if PRINT1 is a product-type matching a selected product-type predefined for the printer 10. If PRINT1 is one of the product-types predefined for the printer, the controller processes at 129 any data or other commands which follow thereafter. If PRINT1 is not a predefined product-type for the printer 10, then the controller checks if it represents a product-type addressing command 130. Since it does not, the controller discards that part of the input data at 132, and then evaluates the next part of the input data at 128. The processing at 129 depends on the data following the PTYPE command, such as discussed below as either merge mode at 98 and 100, processing of applications program at 102, or printing 104.

The input data received by the controller when two or more printers are addresses, may be, for example, PTYPE PRINTER1 PRINTER2 <Data to be Printed, or other commands>, where PRINTER1 and PRINTER2 each represent a different product or model type of printer. The operation of the controller is the same as in the single addressed product-type case, except that the controller will evaluate each of the product-types listed after PTYPE through 128, 130, and 132 until a product-type matching the product-type of the printer is detected at 128. If no product-type matching the product-type of the printer is present, the controller will continue to ignore all data from the terminal until it receives a PTYPE command having one of its predefined product-types.

The input data received by the controller when all printers are designated, may be, for example, PTYPE ALL <Data to be printed, or other commands>, where ALL represents a universal product-type identifier which is stored as one of the predefined product-types for all of the printers. The operation of the controller is the same as in the single addressed product-type case, but the controller will detect ALL as a predefined product-type for the printer at 128 and process the command/data presented thereafter at 129. After an ALL follows a PTYPE command, printers of all product-types will respond to all commands/data until the next PTYPE command is issued, thus returning all the printers to their default state of responding to any data sent from the terminal.

A computer terminal can thus designate or select by product-type which types of printers receiving its data will print. Each of the printers receives data from the terminal, but only operates responsive to such data when such communication addresses a product-type matching one of the product-type predefined in the printer.

Returning to FIG. 6, after obtaining the application program or data from the host, the controller decides whether the merge mode 98 is invoked. The program and data are either used directly to establish conditions for printing or are merged 100 with the host's program and data and with other parameter data stored onboard the printer, then processed 102. The processing may be as described in the '800 patent.

Figure 8:
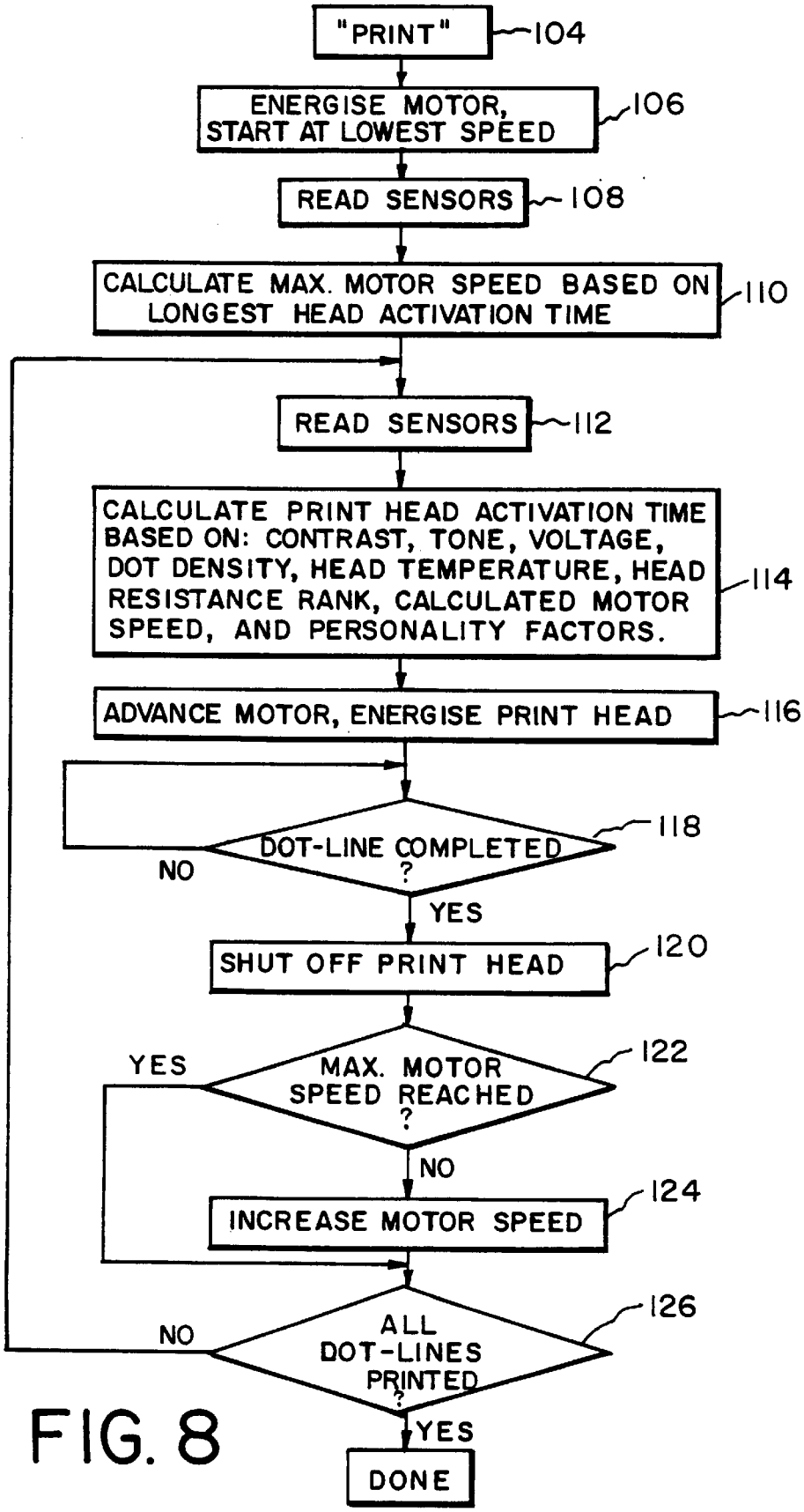
FIG. 8 is a flow chart of the "Print" subroutine for creating a label (operating the printer) which is used in the program shown in FIG. 6.
Figure 9:
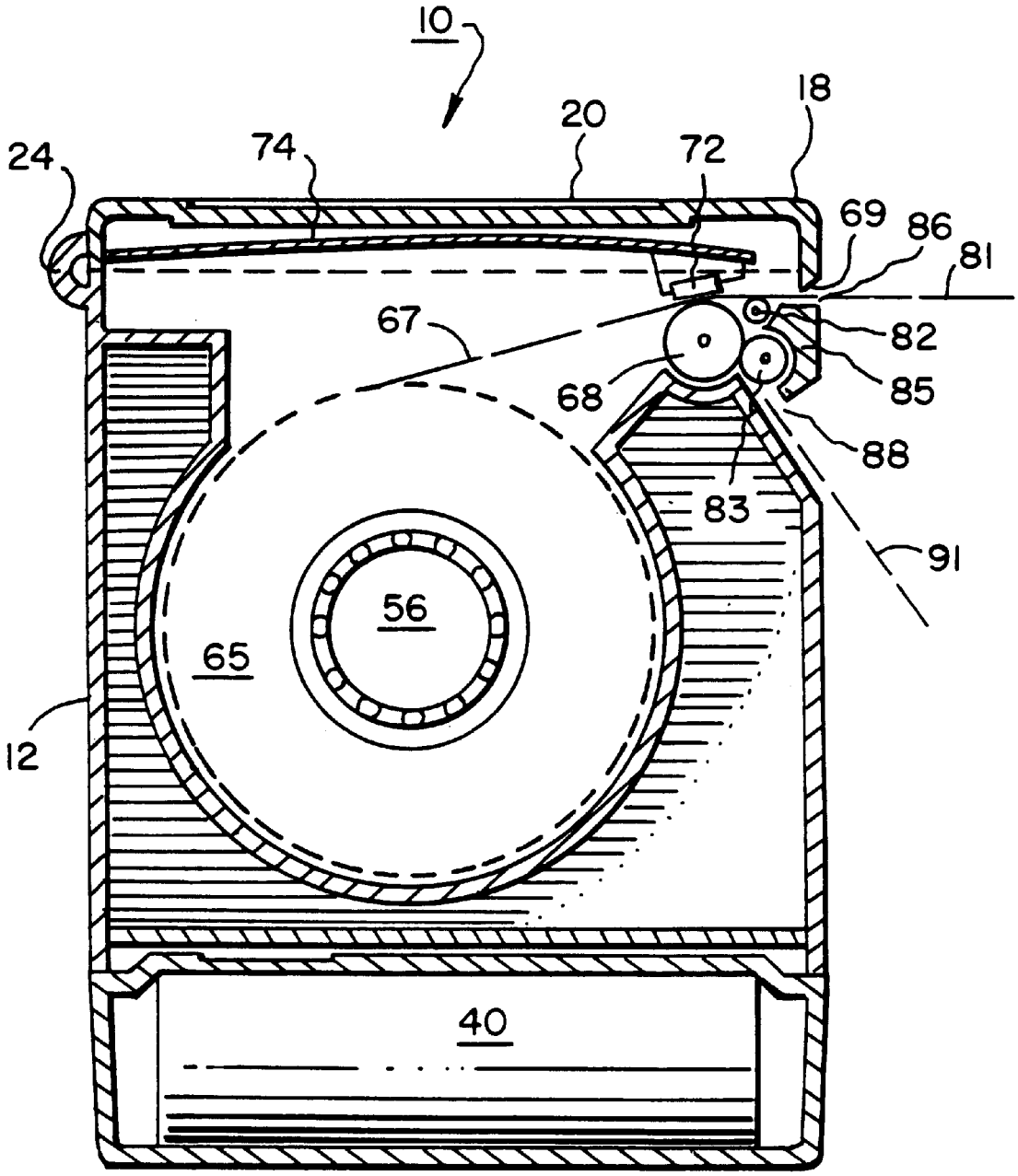
FIG. 9 is a simplified cross-sectional view of the printer shown in FIGS. 1 through 4 taken along line 9—9 in FIG. 1, showing the web path through the printer.

The sequence of events for printing a label is shown in FIG. 8. At the print command 104, the controller energizes 106 the stepper motor 27 at its lowest forward speed. Sensors for battery voltage and head temperature are read 108 and the values obtained are combined with data representing dot density. A maximum usable motor speed for printing is calculated 110 using these parameters and data in a first algorithm based on the longest activation time for the print head to be heated to a desired printing temperature. The sensors are read again 112, and a new print head activation time is calculated 114 via a second algorithm based on the above parameters, the just-calculated maximum motor speed, and data representing contrast, tone, head resistance rank, and individual printer personality factor. The motor is energized and advances until a first indicium on the web is encountered, or for a preset length of web stock, to index the web in the printer mechanism. Then print head and motor are energized 116, and a line of printing is carried out 118, the print head energy and the motor speed being optimum for the parameters and conditions inputted to the controlling algorithms. The print head is shut off 120, and the controller interrogates whether the calculated top motor speed was reached 122. If not, the motor speed is increased 124 and another line of dots is printed. When the proper motor speed has been reached, all printing is carried out 126 and the printer is shut down.

The label is printed by reading out data from memory into the head array. The data is successively printed to create (print) the label. The requested label quantity is decremented and if the quantity is greater than zero, the process returns to print the same material on the next label. If the new label is to be printed with fresh material, the check status routine is again invoked. However, before reprinting, the reset bit can be checked because, if it is high, the printer has been powered off and then on. This is quite likely, since it is desirable to turn the printer off, except when it is to print a label, for battery power conservation. An acknowledge command is received from the terminal to assure that the terminal's program to output data and commands for the label will be transmitted to the printer.

Figure 10:
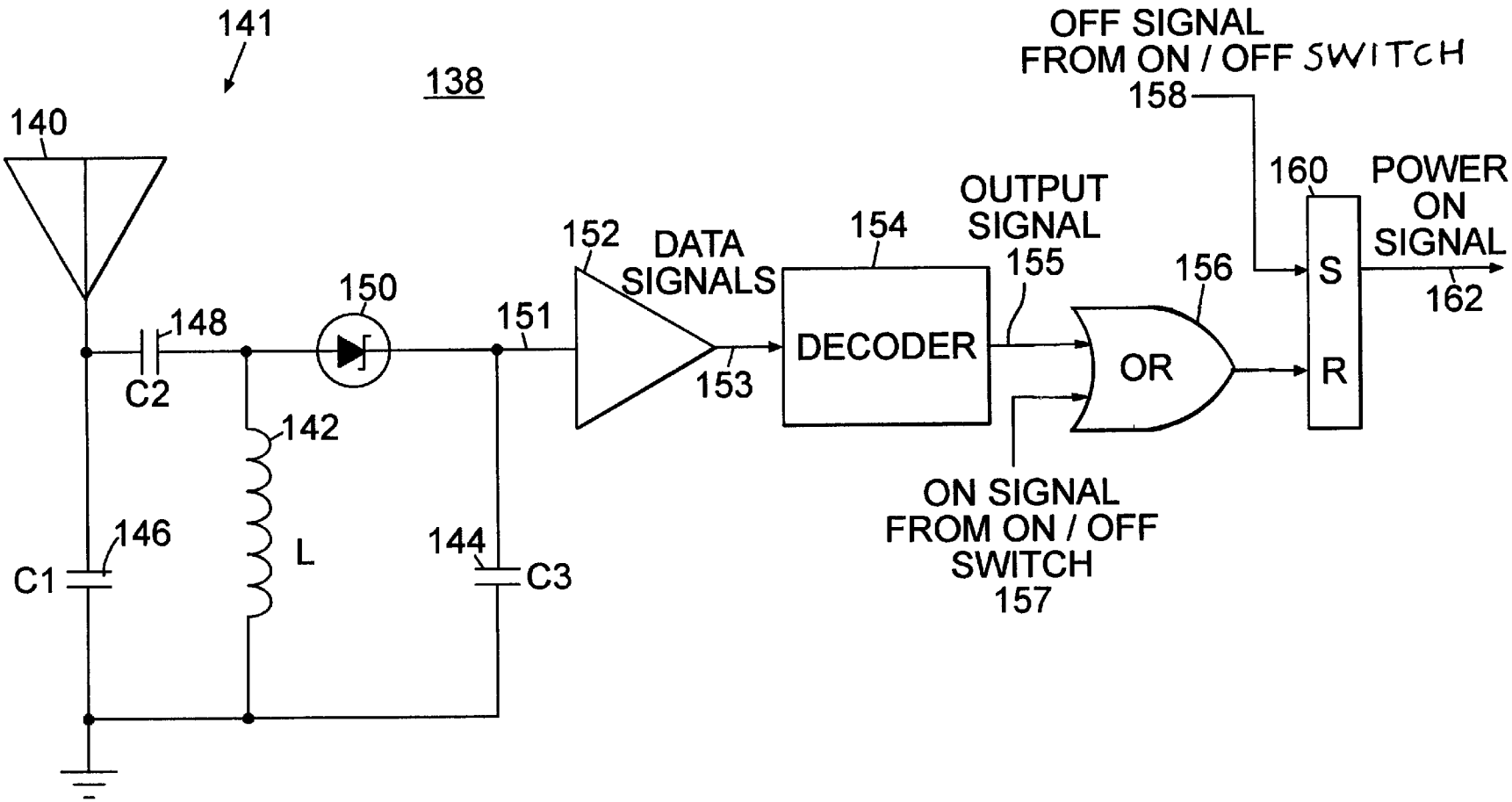
FIG. 10 is a schematic of the wake-up circuit in accordance with one embodiment of the present invention.

Referring to FIG. 10, a wake-up circuit 138 for printer 10 is shown which may reside in the power management circuits 36 (FIG. 5). The wake-up circuit 138 turns on the printer 10 from an off state in which all components of the printer 10 are not powered, except for those of the wake-up circuit 138 as described herein. A computer terminal can automatically turn on printer 10 by transmitting RF signals (i.e., the wake-up signal) at a frequency having an amplitude variation corresponding to a bit pattern of the wake-up code for the printer. In the wake-up circuit 138, an antenna 140, inductor (L) 142, capacitor (C1) 146, and capacitor (C2) 148 represent a tuned inductor circuit 141 for receiving signals in a predefined frequency range in which RF signals with the wake-up code will be received, where C1 has capacitance substantially greater that C2. Often tuned inductor circuit 141 is referred to as a tuned RF transformer. The energy from the RF signals of the frequency range of the tuned inductor circuit charges a capacitor (C3) 144 through diode 150. Diode 150 may be, for example, a Schottky diode 150.

The capacitor 144 is connected to the input of a comparator 152, such that when the voltage on the capacitor is above a threshold level, such as 50 mV, data signals 153 corresponding to the received RF signals are produced by comparator 152. Comparator 152 may be a low power operational amplifier 152 configured as a comparator. The decoder 154 receives the data signals 153 and determines if the bit pattern of the data signals at any time corresponds to a wake-up code predefined for the printer. If so, the decoder 154 produces an output signal 155. More than one wake-up code may be predefined in the decoder of the printer, and the same wake-up code could be present in multiple printers so that such multiple printers can simultaneously be turned on. The decoder 154 may be, for example, a shift register which clocks in data signals 153, and when the data signals represent the bit pattern of the wake-up code, logic gate(s) connected to the shift register produce output signal 155. Decoder 154 may also be a microprocessor, such as a PIC microprocessor used in LCD watches, which samples the bit patterns of data signals 153 and produces output signal 155 when the bit pattern matches at least one of the wake-up codes.

If the decoder 154 determines that the bit pattern of the data signals corresponds to a wake-up code, the decoder sends output signal 155, which may represent a high level signal (approximately 5 V) or a pulse, to one of the inputs of a wired OR gate 156. At another input of the OR gate 156, an ON signal from an on/off switch of keypad 20 (FIG. 5) can be received, such that when the switch is depressed, a high level signal or pulse 157 is provided to the OR gate. Since normally the inputs of the OR gate 156 are at a low level (approximately 0 V), the OR gate responsive to a high level at its input provides a high level signal to the Reset input of a set-reset (S-R) flip-flop 160. This resets the flip-flop 160 which results in the flip-flip outputting a Power On signal 162. The Power On signal activates a switch (or relay) in the power supply 38 (FIG. 5) to enable power to be supplied to the printer board 37 and thus to the components of the printer, such as controller 34, interfaces 42–46, and the printer mechanism, thereby turning on the printer 10. At the set input of flip-flop 160, an OFF signal can be received from the on/off switch of keypad 20 (FIG. 5), such that when the switch is again depressed, a high level signal or pulse 158 is received at the set input of the flip-flop 160, which causes the Power On signal from the flip-flop to cease, thereby deactivating the switch in the power supply and turning off power to the printer. When the printer is in such an off state, only the comparator 152, decoder 154, OR gate 156, and flip-flop 160 receive power in the printer, thereby greatly reducing the power consumption of the power source 38.

Although less preferred, the wake-up circuit 138 may operate without the decoder 154 or a wake-up code pattern, where the wake-up signal represents RF signals having sufficient energy to charge capacitor 144 to produce a voltage at the input of the comparator 152 above a threshold voltage level. The data signals 153 from comparator 152 provide the output signal 155 to the OR gate 156. By removing the decoder 154 even less power is used in the circuit 138, however, this may increase the possibility of a false wake-up signal due to spurious RF signals received by the wake-up circuit.

In another embodiment of the present invention, the wake-up circuit 138 is not included in printer 10, and the printer is turned on from a low powered "off" state by the controller 34 responsive to receiving a wake-up signal at one of communication interfaces 42–46. In the low powered state, one or more of communication interfaces 42–46 remain powered to receive the wake-up signal, the clock rate of the controller 34 is slowed, and power sufficient to retain memory 52 is provided. All other components in the printer need not be powered during the off state. To enter the low powered off state, the controller 34 removes power to these components and slows down its clock rate. Intermediate levels of power down may be provided until the printer reaches its low powered off state. The controller causes the printer to enter an off state either after a predefined period of inactivity after receiving an off command via one or more communication interfaces 42–46, or via keypad entry by a user. When the printer is in a low powered state, the wake-up signal represents any data representing one or more characters from infrared or radio communication interface 44 or 46. The wake-up signal from serial communication interface 42 is described in the '800 patent as a "soft on/off" by the terminal providing a signal on the DTR (Data Terminal Ready) line. In response to receiving the wake-up signal, the controller reset its clock speed to its normal rate, and powers and sets up the components of the printer to enable printing.

From the foregoing description it will be apparent that there has been provided an improved printer which may be implemented as a miniature, portable, intelligent, and interactive device. Variations and modifications of the herein described printer within the scope of the invention will undoubtedly suggest themselves to those skilled in this art. Accordingly, the foregoing description should be taken as illustrative and not in a limiting sense.

We claim:

1. A printer responsive to data from a terminal representing commands and information to be printed, said printer comprising:

a printer mechanism for a portable label printer;

means for receiving said data from said terminal; and a controller for operating said printer mechanism in accordance with said received data having a command which addresses at least one printer product-type predefined for the specific printer.

2. The printer according to claim 1 wherein said printer is at least one of a plurality of said printers, and said data having said command is received by said plurality of printers and only those of said plurality of printers having at least one of the predefined printer product-types operate responsive to said data.

3. A printer which can automatically be turned on from a terminal, said printer having an electronic controller and a power source for supplying power to said printer, said printer comprising:

means for receiving RF signals from the terminal; and circuitry connected to said means for enabling power to be supplied from the power source to the controller when said RF signals are received from said terminal, thereby turning on said printer, wherein said printer weighs less than 2 pounds.

4. The printer according to claim 3 wherein said RF signals have an amplitude above a threshold level.

5. The printer according to claim 3 wherein said RF signals correspond to a bit pattern of at least one predefined wake-up code.

6. The printer according to claim 3 wherein said receiving means operates in a preset frequency range and said RF signals have a frequency within said frequency range.

7. The printer according to claim 3 wherein said enabling means enables power when said RF signals represent a wake-up signal from said terminal.

8. The printer according to claim 3 wherein said circuitry comprises:

first means connected to said receiving means for converting said RF signals into data signals when the amplitude of said RF signals is above a threshold level;

second means for receiving said data signals and providing an output signal when said data signals represent at least one predefined wake-up code; and third means responsive to said output signal from said second means for enabling power to be supplied from the power source to the controller.

9. The printer according to claim 3 wherein said circuitry comprises:

first means connected to said receiving means for converting said RF signals into an output signal when the amplitude of said RF signals is above a threshold level; and second means responsive to said output signal from said first circuit for enabling power to be supplied from the power source to the controller.

10. The printer according to claim 3 wherein said receiving means comprises an antenna capable of receiving said RF signals.

11. A printer which can be turned on responsive to RF signals, said printer having an electronic controller for operating said printer and a power source for supplying power to said printer, the printer comprising:

an antenna for receiving said RF signals;

a comparator connected to said antenna for converting said RF signals into data signals when the amplitude of said RF signals is above a threshold level;

a decoder for receiving said data signals and providing an output signal when said data signals having a bit pattern representing at least one predefined wake-up code; and a flip-flop responsive to said output signal from said decoder for enabling power to be supplied from the power source to the controller, thereby turning on said printer.

12. A printer which can be turned on responsive to RF signals, said printer having an electronic controller for operating said printer and a power source for supplying power to said printer, the printer comprising:

an antenna for receiving said RF signals;

a comparator connected to said antenna for converting said RF signals into an output signal when the amplitude of said RF signals is above a threshold level; and a flip-flop responsive to said output signal from said first circuit for enabling power to be supplied from the power source to the controller, thereby turning on said printer.

13. A printer responsive to a wake-up signal from a terminal for turning on the printer from a low powered state to enable printing, said printer comprising:

a printer mechanism for a portable label printer;

means for receiving one of an infrared signal and a RF wake-up signal from said terminal; and a controller which turns on the printer mechanism responsive to said received wake-up signal, wherein said printer weighs less than 2 pounds.

14. The printer according to claim 13 wherein said wake-up signal represents data of one or more characters.

15. A system for operating a plurality of portable label printers responsive to said data received by the printers, said system comprising:

a plurality of portable label printers each of said printers being of at least one predefined printer type; and means in each of said plurality of printers for enabling operation thereof responsive to data received by the printer when said data is addressed to only at least one of said plurality of printers by the printer type predefined for the printer.

16. The system according to claim 15 wherein said plurality of printers represent a network of printers.

17. The system according to claim 15 further comprising:

a terminal for sending said data to said plurality of printers.

18. A method for operating a plurality of printers responsive to said data received by the printers, said method comprising the steps of:

sending data to a plurality of portable label printers addressed to one or more of the printers by their printer product-type;

receiving said data at each of the printers; and operating each of said printers in accordance with the received data when at least one of printer product-types predefined for the printer is addressed to only at least one of said printers.

19. The method according to claim 18 further comprising the step of:

operating all of said printers in accordance with said data when a universal product-type identifier is addressed.

20. The printer according to claim 1 wherein said controller comprises:

means for operating said printer mechanism in a default state in accordance with said received data from said receiving means and discontinuing operation of the printer mechanism when said received data has a product-type command not defined for the printer.

21. The printer according to claim 20 wherein said controller has means for entering said default state in response to said received data having a certain product-type command.

22. The system according to claim 15 wherein different ones of said printers can be of the same predefined printer type.

* * * * *